US007391429B2

(12) United States Patent
Yang

(10) Patent No.: US 7,391,429 B2
(45) Date of Patent: Jun. 24, 2008

(54) IMAGE FORMING APPARATUS AND METHOD OF USING THE SAME

(75) Inventor: Yong-sok Yang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 263 days.

(21) Appl. No.: 11/256,057

(22) Filed: Oct. 24, 2005

(65) Prior Publication Data

US 2006/0114310 A1 Jun. 1, 2006

(30) Foreign Application Priority Data

Nov. 26, 2004 (KR) ..... 10-2004-0097994

(51) Int. Cl.
*B41J 2/32* (2006.01)

(52) U.S. Cl. ..... 347/218; 347/174

(58) Field of Classification Search ..... 347/171–176, 347/218; 400/188
See application file for complete search history.

(56) References Cited

U.S. PATENT DOCUMENTS

| | | | | |
|---|---|---|---|---|
| 5,101,222 | A | 3/1992 | Hakkaku | |
| 6,296,405 | B1 | 10/2001 | Brewington | |
| 6,705,786 | B2 * | 3/2004 | Trovinger | 400/645.3 |
| 7,179,002 | B2 * | 2/2007 | Lee et al. | 400/120.17 |
| 2001/0021331 | A1 | 9/2001 | Brewington | |
| 2001/0022609 | A1 | 9/2001 | Suzuki | |
| 2003/0194253 | A1 * | 10/2003 | Trovinger | 400/188 |
| 2004/0028450 | A1 * | 2/2004 | Jung | 400/709 |
| 2005/0078139 | A1 * | 4/2005 | Kang et al. | 347/19 |
| 2005/0078996 | A1 | 4/2005 | Lee | |
| 2005/0140770 | A1 | 6/2005 | Kang | |
| 2005/0259141 | A1 * | 11/2005 | Kim et al. | 347/197 |
| 2005/0276649 | A1 * | 12/2005 | Min | 400/120.16 |
| 2006/0023057 | A1 * | 2/2006 | Jung | 347/179 |
| 2006/0092260 | A1 * | 5/2006 | Min | 347/209 |
| 2006/0238601 | A1 * | 10/2006 | Nam | 347/197 |

FOREIGN PATENT DOCUMENTS

| | | |
|---|---|---|
| JP | 06-183096 | 7/1994 |
| JP | 08-192524 | 7/1996 |
| JP | 08-267845 | 10/1996 |
| JP | 09-123492 | 5/1997 |
| JP | 2003-094758 | 4/2003 |
| KR | 100184477 | 8/1996 |
| KR | 1020040049472 | 6/2004 |

* cited by examiner

*Primary Examiner*—Huan H Tran
(74) *Attorney, Agent, or Firm*—Roylance, Abrams, Berdo & Goodman, L.L.P.

(57) ABSTRACT

An image forming apparatus includes an image forming unit that prints an image on a medium, a transporting unit that transports the medium in a first direction and a second direction, which is the opposite to the first direction, and a sensor that is placed a predetermined distance away from the transporting unit in the second direction to detect the medium. The image forming apparatus aligns the print start location of the medium with an image forming line of the image forming unit by detecting an end of the medium in the second direction using the sensor.

20 Claims, 5 Drawing Sheets

IMAGE FORMING APPARATUS AND METHOD OF USING THE SAME

CROSS REFERENCE TO RELATED APPLICATIONS

This application claims the priority under 35 U.S.C. § 119(a) of Korean Patent Application No. 10-2004-0097994, filed on Nov. 26, 2004 in the Korean Intellectual Property Office, the entire disclosure of which is hereby incorporated by reference.

BACKGROUND OF THE INVENTION

1. Field of the Invention

The present invention relates to an image forming apparatus and a method of using the same. More particularly, the present invention relates to an image forming apparatus that prints an image by matching a print start location of a medium with an image forming line, and a method of forming an image using the same.

2. Description of the Related Art

When printing an image on a medium, the image needs to be located accurately at a predetermined location of the medium. In particular, a medium for printing photographs includes a printing area on which an image is printed and a non-printing area on top and bottom of the printing area. The non-printing area may also be formed on both side edges of the printing area. The printing area and the non-printing area are typically divided via perforated or dotted lines. An image is printed slightly larger than the printing area, and if the non-printing area is torn or cut along the perforated or dotted lines, a borderless printed image just like a developed photograph is obtained. In this case, the image has to start printing exactly from a print start location of the medium if the image is to be borderlessly printed without any loss. Additionally, even in a general printing process, the image has to be printed starting precisely from the print start location of the medium to print the image without any loss. If the image is printed before the print start location, the top region of the image can be lost and if the image is printed below the print start location, the bottom region of the image can be lost.

When printing a color image, a medium is repeatedly moved back and forth to superimpose cyan, magenta, and yellow images. If the print start locations of the cyan, magenta, and yellow images are not identical, the cyan, magenta, and yellow images will not accurately overlap with one another, thereby resulting in a poor quality color image.

Accordingly, a need exists for an improved image forming apparatus and a method that provides quality color images without image loss.

SUMMARY OF THE INVENTION

The present invention provides an image forming apparatus that substantially prevents image loss and produces good quality color images, and a method of using the same.

According to an aspect of the present invention, an image forming apparatus includes an image forming unit that prints an image on a medium, a transporting unit that transports the medium in a first direction and a second direction, which is the opposite to the first direction, and a sensor that is placed a predetermined distance away from the transporting unit in the second direction to detect the medium. The image forming apparatus aligns the print start location of the medium with an image forming line of the image forming unit by detecting an end of the medium towards the second direction using the sensor.

According to an aspect of the present invention, a bar code is formed on at least one end of the medium in the first and second directions. The bar code has information regarding the medium. The sensor is located to read the bar code. Additionally, the image forming apparatus further includes a bar code sensor that reads the bar code.

According to another aspect of the present invention, an image forming apparatus includes an image forming unit that prints an image on a medium, a transporting unit that transports the medium in a first direction and a second direction, which is the opposite to the first direction, and a sensor that is placed a predetermined distance away from the image forming unit in the first direction to detect the medium. The image forming apparatus aligns the print start location of the medium with the image forming line of the image forming unit by detecting an end of the medium towards the first direction using the sensor.

According to an aspect of the present invention, a bar code is formed on at least one end of the medium in the first and second directions. The bar code has information regarding the medium. The sensor is located to read the bar code. Additionally, the image forming apparatus further includes a bar code sensor that reads the bar code.

According to an aspect of the present invention, the medium is a thermal medium including at least one thermal ink layer. The image forming unit includes a thermal printing head that prints the image by applying heat to the medium and a platen roller that supports the medium by being placed opposite the thermal printing head. The thermal printing head moves to a first location opposite a first surface of the medium and a second location opposite a second surface of the medium, which is the opposite of the first surface, and prints an image at the first location and the second location. The thermal printing head rotates with a rotation axis of the platen roller as a pivot to move to the first location and the second location.

According to another aspect of the present invention, there is provided a method of forming an image. The method includes providing an image forming unit that prints an image on a medium. A transporting unit transports the medium in a first direction and a second direction, which is the opposite to the first direction. A sensor is placed a predetermined distance away from the transporting unit in the second direction for detecting the medium. The image forming unit is placed at a first location, opposite a first surface of the medium. An end of the medium towards the second direction is detected using the sensor while transporting the medium in the first direction. The medium is stopped when the end of the medium towards the second direction is placed between the transporting unit and the sensor. The end of the medium towards the second direction is again detected while transporting the medium in the second direction. A print start location of the medium is then aligned with an image forming line of the image forming unit by further transporting the medium a predetermined distance. An image is printed on the first surface of the medium while transporting the medium in the second direction.

The method further includes placing the image forming unit at a second location, opposite a second surface of the medium. The end of the medium towards the second direction is detected, while transporting again the medium having the image formed on the first surface, in the first direction using the sensor. The medium is stopped when the end of the medium towards the second direction is placed between the transporting unit and the sensor. The end of the medium is again detected towards the second direction while transporting the medium in the second direction using the sensor. The print start location of the medium is then aligned with the image forming line of the image forming unit by further transporting the medium a predetermined distance. An image is printed on the second surface of the medium while transporting the medium in the second direction.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which exemplary embodiments of the invention are shown.

Figure 1:
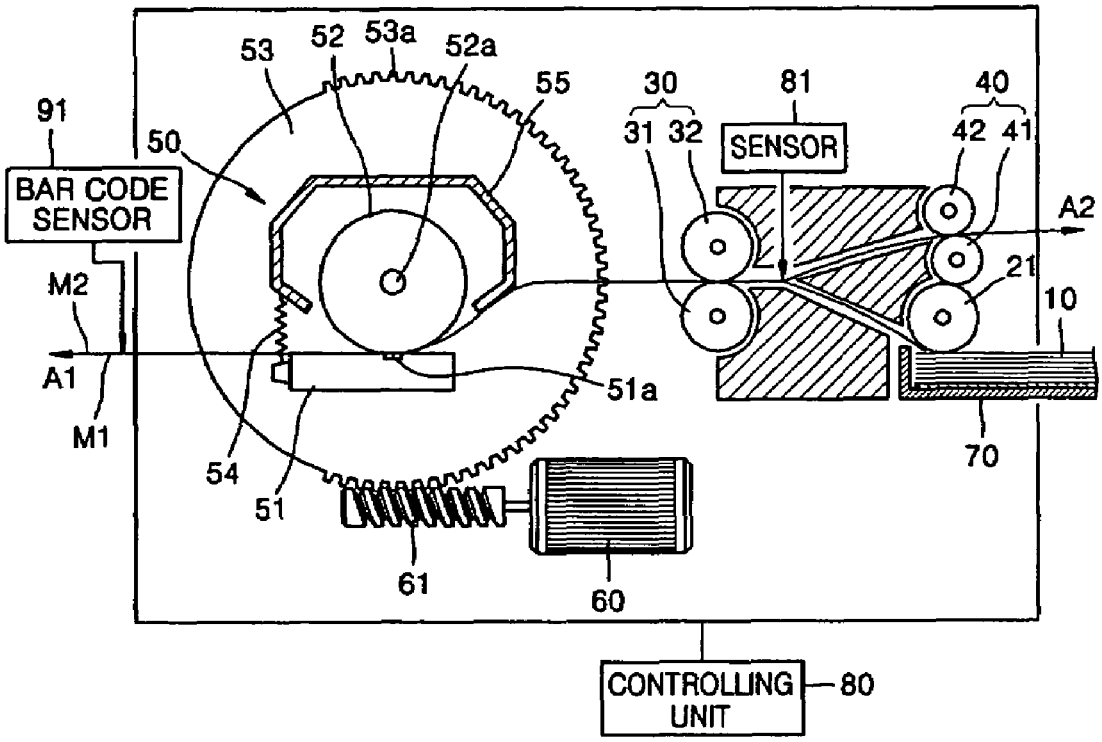
FIG. 1 is a schematic structural diagram of an image forming apparatus according to an embodiment of the present invention.

FIG. 1 is a schematic structural diagram of an image forming apparatus according to an exemplary embodiment of the present invention. The image forming apparatus in an exemplary embodiment is a thermal-type image forming apparatus that prints an image by applying heat to a medium having thermal ink layers. Referring to FIG. 1, an image forming unit 50 includes a thermal printing head (TPH) 51 that forms an image by applying heat to a medium 10 and a platen roller 52 which supports the medium 10 by being placed opposite the TPH 51. An elastic element 54 presses the TPH 51 towards the platen roller 52. The medium 10 is stacked in a cassette 70. A pickup roller 21 that picks up the medium 10 is disposed above the cassette 70. A transporting unit 30 disposed between the image forming unit 50 and the pickup roller 21 transports the medium 10 in a first direction A1 and a second direction A2. The TPH 51 prints an image on the medium 10 while the medium 10 is being transported in the second direction A2. The transporting unit 30 includes, for example, a transporting roller 31 and an idle roller 32 that meshes with the transporting roller 31. A discharging unit 40 includes, for example, a discharging roller 41 that rotates in contact with the pickup roller 21 and an idle roller 42 that meshes with the discharging roller 41. A sensor 81, which detects the medium 10, is located slightly away from the transporting unit 30 in the second direction A2.

Figure 3:
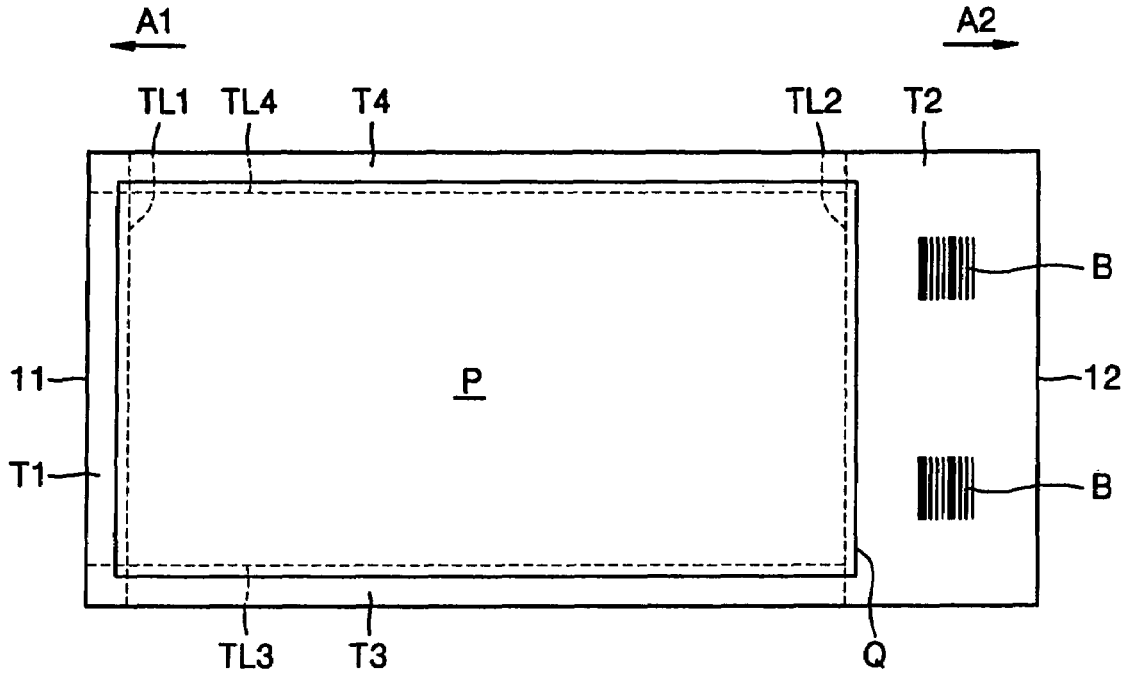
FIG. 3 is a top plan view of a medium according to an exemplary embodiment of the present invention.

As illustrated in FIG. 3, the medium 10 may have a print area P and non-print areas T1 and T2 on top and bottom of the print area P. The medium 10 may further have non-print areas T3 and T4 on the both side edges of the print area P. The print area and the non-print areas T1, T2, T3, and T4 are distinguished via dotted or perforated lines TL1, TL2, TL3, and TL4. When performing borderless printing, an image is printed slightly larger than the print area P, as illustrated by a solid line in FIG. 3. The non-print areas T1, T2, T3, and T4 are cut away by cutting (or tearing) along the dotted (or perforated) lines TL1, TL2, TL3, and TL4. Then, borderless printing similar to a developed photograph is obtained. The image is printed to slightly overlap the dotted lines TL1, TL2, TL3, and TL4 (for example, by about 2 mm). In this case, the length of the non-print areas T1, T2, T3, and T4 may preferably be a minimum of about 2 mm. The length of the non-print area T2 is preferably longer than at least the distance between the transporting unit 30 and a heating line (that is, image forming line) 51*a*. The print start location Q is distanced from the dotted lines TL2, for example, by about 2 mm, in the second direction A2 and is located within the non-print area T2. Preferably, the sensor 81 is located as close as possible to the transporting unit 30 to shorten the length of the non-print area T2.

The sensor 81 is used to precisely locate the print start location Q of the medium 10 at the heating line 51*a* of the TPH 51. The sensor may be a photo sensor. For example, the sensor 81 transmits a high signal to a controller 80 if the medium 10 is detected and transmits a low signal to the controller 80 if the medium 10 is not detected. The controlling unit 80 recognizes whether the top end 11 of the medium 10 (i.e., an end of the medium 10 in the first direction A1) or the bottom end 12 of the medium 10 (i.e., an end of the medium 10 in the second direction A2) is detected by a change in the signal output from the sensor 81.

Figure 5:
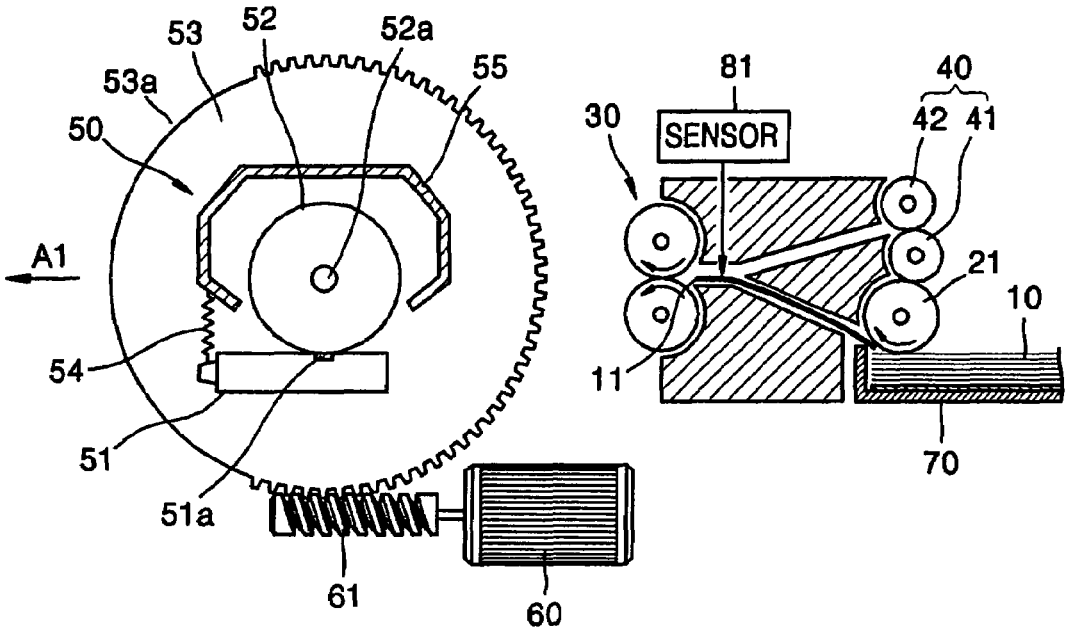
FIGS. 5 through 7 are schematic structural diagrams illustrating a process of matching a print start location of the medium to a heating line of the TPH to print an image on a first surface of the medium according to an exemplary embodiment of the present invention.
Figure 6:
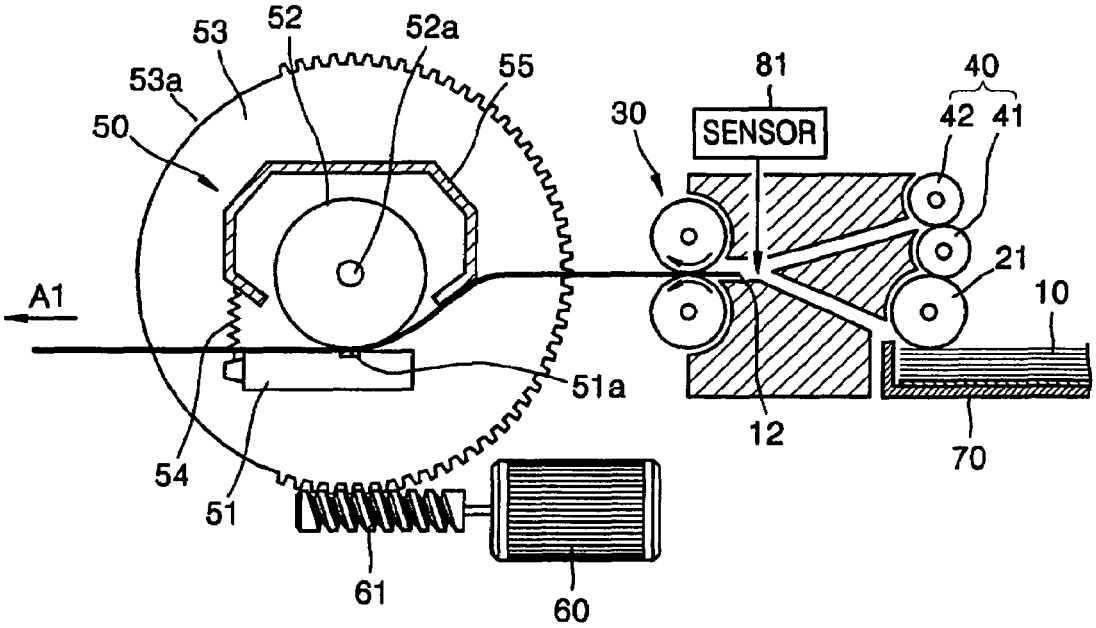

As illustrated in FIG. 5, when the top end 11 of the medium 10 picked up from the cassette 70 via the pickup roller 21 passes the sensor 81, a signal of the sensor 81 changes from low to high. The controlling unit 80 recognizes that the top end 11 of the medium 10 is detected and determines that the pickup process was successfully carried out. The transporting unit 30 continues to transport the medium 10 in the first direction A1. As illustrated in FIG. 6, when the bottom end 12 of the medium 10 passes the sensor 81, the signal of the sensor 81 changes from high to low. The controlling unit 80 recognizes that the bottom end 12 of the medium 10 is detected. Thus, the transporting unit 30 stops transporting the medium 10. The bottom end 12 of the medium 10 is located between the transporting unit 30 and the sensor 81.

Figure 7:
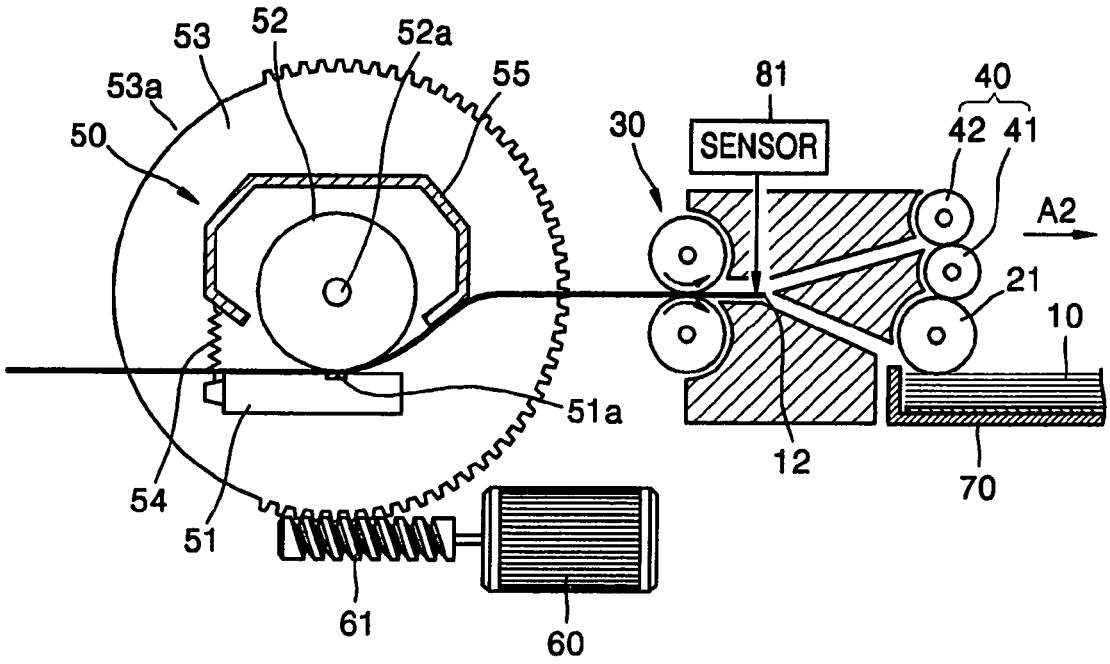

The transporting unit 30 transports the medium 10 in the second direction A2 to print an image. As illustrated in FIG. 7, when the bottom end 12 of the medium 10 passes the sensor 81, the signal changes from low to high, and the controlling unit 80 again recognizes that the bottom end 12 of the medium 10 is detected. After a predetermined period of time passes from this point (after the medium 10 is transported a predetermined distance in the second direction A2), the print start location Q of the medium 10 reaches the heating line 51*a* of the TPH 51. The TPH 51 applies heat to the medium 10 to print the image. When printing is completed, the medium 10 is discharged via the discharging unit 40.

The medium 10 may be loosened, not tensed, between the transporting unit 30 and the image forming unit 50. In particular, there is a higher probability that the medium 10 is loosened when the TPH 51 and the platen roller 52 distanced while the medium 10 is transported in the first direction A1 are elastically engaged with each other with the medium 10 disposed therebetween before the medium 10 is transported in the second direction A2. In this case, even if the transporting unit 30 transports the medium 10 in the second direction A2, the medium 10 is not transported until the medium 10 near the heating line 51*a* of the TPH 51 is tensed. Therefore, it is difficult to match the print start location Q of the medium 10 with the heating line 51*a* of the TPH 51. To solve this problem, in an exemplary embodiment, the medium 10 is transported in the first direction A1 until the bottom end 12 of the medium 10 is located between the transporting unit 30 and the sensor 81 after the bottom end 12 of the medium 10 is detected. Then, the medium 10 is transported in the second direction A2 so that the medium 10 becomes tense between the transporting unit 30 and the image forming unit 50. Then, the bottom end 12 of the medium 10 is sensed again, and from this point, the print start location Q may be precisely aligned with the heating line 51*a* of the TPH 51 by transporting the medium 10 a predetermined distance in the second direction A2. As such, the image may be printed without any loss by matching the print start location Q of the image with the heating line 51*a* of the TPH 51 using the sensor 81.

Figure 4:
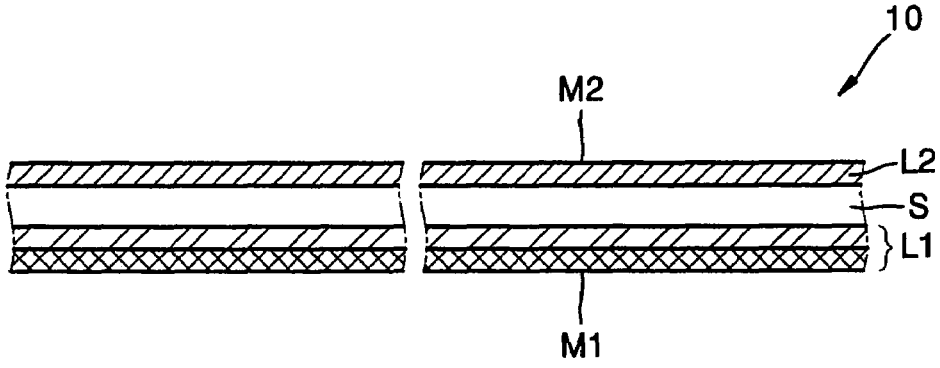
FIG. 4 is a cross-section of the medium of FIG. 3.

The medium 10 used in the image forming apparatus may have a structure as illustrated in FIG. 4. Thermal ink layers L1 and L2, which display predetermined colors by reacting to heat, are respectively formed on a first surface M1 and a second surface M2 of a base sheet S of the medium 10. The thermal ink layers L1 and L2 may have a single layer structure to manifest a single color or a multiple layer structure to manifest more than two colors. As an example, two layers may be formed on the thermal ink layer L1 to display yellow and magenta colors, and a single layer may be formed on the thermal ink layer L2 to display a cyan color. The yellow and magenta colors of the thermal ink layer L1 may be selectively manifested by the temperature and heating time of the TPH 51. For example, the yellow color may be displayed when the medium 10 is heated a short period of time at a high temperature and the magenta color may be manifested when the medium 10 is heated a long period of time at a low temperature, and vice versa. If the base sheet S is transparent and the yellow, magenta, and cyan colors are each manifested, a color image is manifested by the superimposed yellow, magenta, and cyan colors. Such a medium 10 is disclosed in U.S. Patent Publication No. 2003-0125206. If the base sheet S is opaque, different images may be printed on the first and second surfaces M1 and M2, making printing on both sides possible. The technical scope of a method of forming an image of exemplary embodiments of the present invention is not limited by the structure of the thermal ink layers L1 and L2 of the first and second surfaces M1 and M2 of the medium 10.

Figure 2:
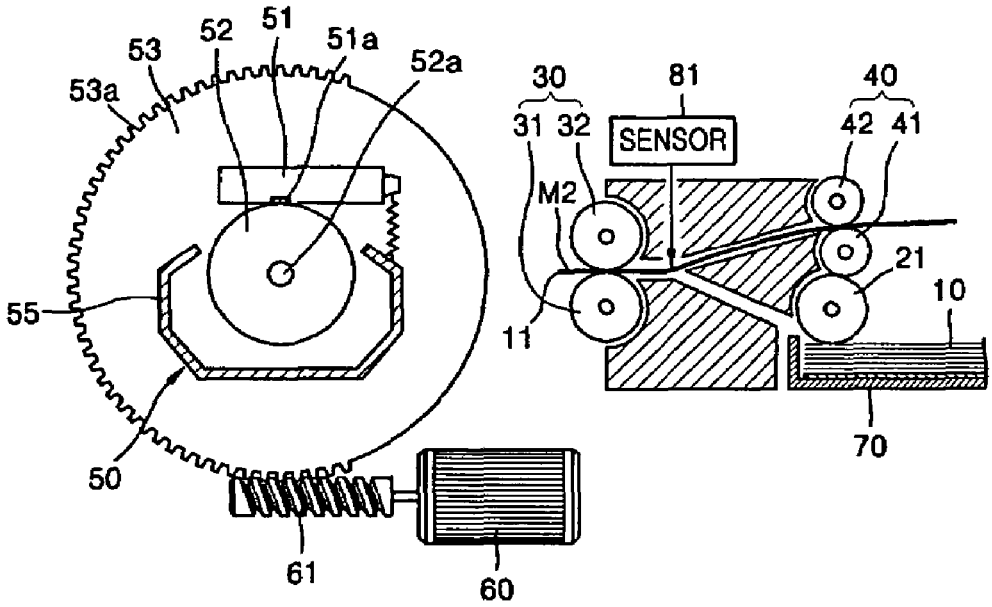
FIG. 2 is a schematic structural diagram illustrating a thermal printing head (TPH) located at a second location.

The TPH 51 may move to a first location (see FIG. 1) opposite the first surface M1 of the medium 10 and to a second location (see FIG. 2) opposite the second surface M2 of the medium 10 to apply heat to the first and second surfaces M1 and M2 of the medium 10. In an exemplary embodiment of the image forming apparatus, the TPH 51 rotates with a rotation axis 52*a* of the platen roller 52 as the pivot and moves to the first and second locations. An example of the structure to move the TPH 51 to the first and second locations are illustrated in FIGS. 1 and 2. Referring to FIGS. 1 and 2, a support bracket 53 that rotates concentrically with the rotation axis 52*a* of the platen roller 52 is illustrated. The TPH 51 is coupled to the support bracket 53. A gear 53*a* is provided on the outer circumference of the support bracket 53. A worm gear 61 that meshes with the gear 53*a* is formed on a rotation axis of a motor 60. According to such structure, the support bracket 53 rotates by driving the motor 60, thereby moving the TPH 51 to the first or second location. A guide 55 is coupled to the support bracket 53 to guide the medium 10 between the TPH 51 and the transporting unit 30. The structure to move the TPH 51 to the first and second locations is not limited to the example provided in FIGS. 1 and 2. Additionally, the scope of the exemplary embodiments of the present invention is not limited to the structure for moving the TPH 51 to the first and second locations illustrated in FIGS. 1 and 2.

Figure 8:
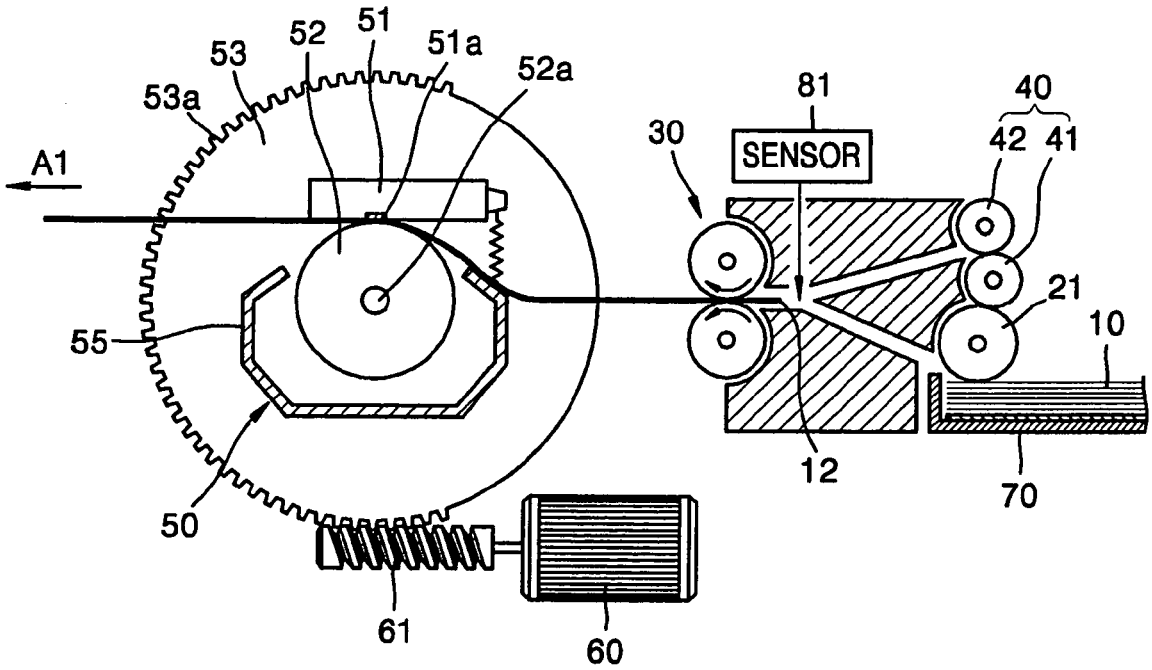
FIGS. 8 and 9 are schematic structural diagrams illustrating a process of matching a print start location of the medium to a heating line of the TPH to print an image on a second surface of the medium according to an exemplary embodiment of the present invention.
Figure 9:
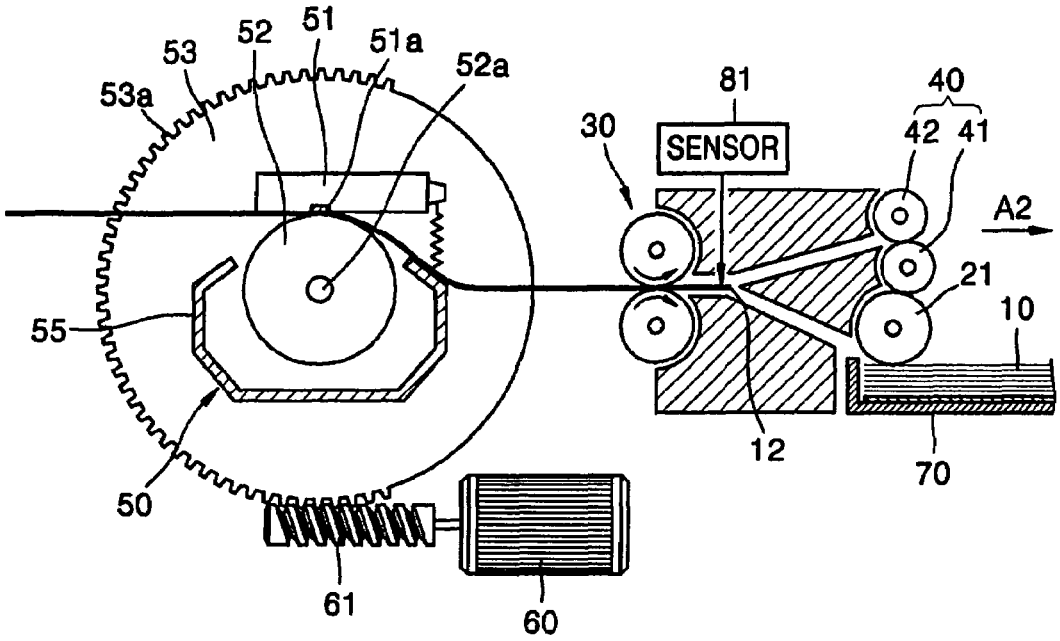

Images of the yellow and magenta colors are printed on the first surface M1 of the medium 10 according to a printing order illustrated in FIGS. 5 through 7. When the top end 11 of the medium 10 passes the image forming unit 50, the transporting unit 30 stops. The top end 11 of the medium 10 may be located between the image forming unit 50 and the transporting unit 30, between the transporting unit 30 and the sensor 81, or between the sensor 81 and the discharging unit 40. When the top end 11 of the medium 10 is placed between the image forming unit 50 and the transporting unit 30, as illustrated in FIG. 2, is described below. The motor 60 moves the TPH 51 to the second location, as illustrated in FIG. 2, by rotating the support bracket 53. The transporting unit 30 moves the medium 10 again in the first direction A1. The medium 10 is guided by the guide 55 and is transported to between the TPH 51 and the platen roller 51. The signal of the sensor 81 changes from high to low when the bottom end 12 of the medium 10 passes the sensor 81, as illustrated in FIG. 8. The controlling unit 80 recognizes that the bottom end 12 of the medium 10 is sensed. The transporting unit 30 stops transporting the medium 10. The TPH 51 is placed opposite the second surface M2 of the medium 10. The bottom end 12 of the medium 10 is placed between the transporting unit 30 and the sensor 81. The transporting unit 30 transports the medium 10 in the second direction A2 to print the image. The signal of the sensor 81 changes from low to high when the bottom end 12 of the medium 10 passes the sensor 81, as illustrated in FIG. 9, and the controlling unit 80 recognizes that the bottom end 12 of the medium 10 is again detected. After a predetermined period of time passes (after the medium 10 is transported a predetermined distance in the second direction A2) from this point, the print start location Q of the medium 10 reaches the heating line 51*a* of the TPH 51 and the TPH 51 applies heat to the medium 10 to print a cyan color image. When printing is completed, the medium 10 is discharged by the discharging unit 40. As such, the yellow and magenta color images printed on the first surface M1 of the medium 10 and the cyan color image printed on the second surface M2 of the medium 10 may be overlapped by using the sensor 81. Therefore, a good quality color image may be printed.

Figure 10:
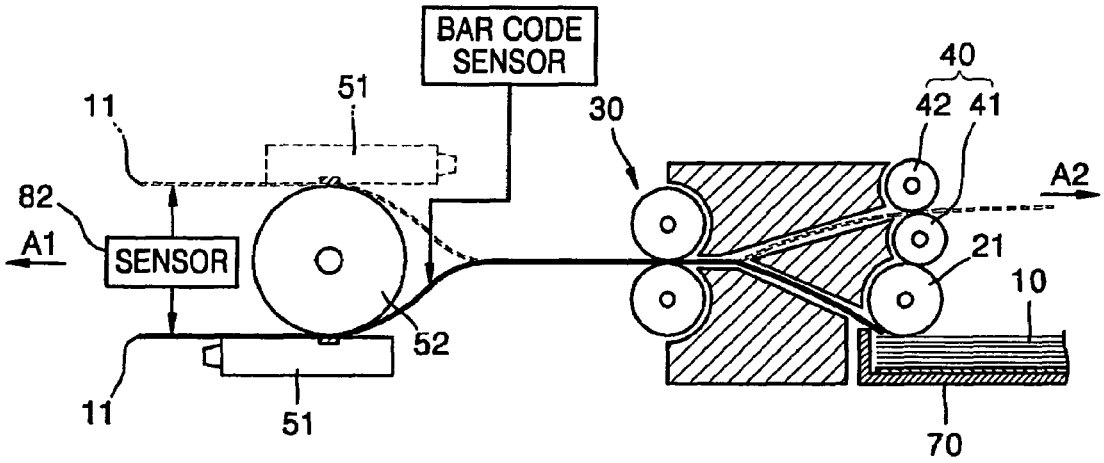
FIG. 10 is a schematic structural diagram of an image forming apparatus according to another exemplary embodiment of the present invention.

A sensor 82 may be placed a predetermined distance away from an image forming unit 50 in a first direction A1, as illustrated in FIG. 10. A print start location Q and a heating line 51*a* of a TPH 51 are aligned with respect to a top end 11 of a medium 10. A signal of the sensor 81 changes from low to high when the top end 11 of the medium 10 picked up by a pickup roller 21 from a cassette 70 passes the sensor 82. A controlling unit 80 recognizes that the top end 11 of the medium 10 is detected and determines that a pickup process has been successfully performed. A transporting unit 30 transports the medium 10 in the first direction A1 considering the distance between the top end 11 of the medium 10 to the print start location Q and then stops when the heating line 51*a* of the TPH 51 is aligned with the print start location Q. The transporting unit 30 transports the medium 10 in a second direction A2, and the TPH 51 prints an image on the medium 10 by applying heat thereto. When printing is completed, the medium 10 is discharged by a discharging unit 40. When color printing using the medium 10 illustrated in FIG. 4, yellow and magenta color images printed on the first surface M1 of the medium 10 and a cyan color image printed on the second surface M2 of the medium 10 may overlap with one another by detecting the top end 11 of the medium 10 using the sensor 82.

Characteristics of the medium 10 may affect the quality of an image. For example, a chemical composition of the thermal layers L1 and L2 may be slightly different depending on manufacturing lots and companies. The heating temperature or time of the TPH 51 may be controlled reflecting such difference in manufacturing lots and companies to provide optimum image quality. To control the heating temperature or time of the TPH 51 depending on the different manufacturing lots and companies, a bar code B containing information regarding characteristics of the medium 10, including the manufacturing company or the manufacturing lot, may be formed on the medium 10 when manufacturing the medium 10, as illustrated in FIG. 3. Preferably, the bar code B is formed on the non-print area T2, as illustrated in FIG. 3. Although not illustrated in FIG. 3, the bar code B may also be formed on the non-print area T1. The length of the non-print area T1 is preferably longer to accommodate the bar code B. Multiple bar codes B, as shown in FIG. 3, may be formed on the medium 10.

The image forming apparatus may further include a bar code sensor 91 to read the bar codes B. In the exemplary embodiments illustrated in FIGS. 1 and 10, the bar code sensor 91 may be formed a predetermined distance away form the transporting unit 30 in the second direction A2, between the transporting unit 30 and the image forming unit 50, or a predetermined distance away from the image forming unit 50 in the first direction A1 when the bar code B is printed on the non-print area T1. When the bar code B is printed on the non-print area T2, the bar code sensor 91 is preferably formed a predetermined distance away from the transporting unit 30 in the second direction A2. The bar code B may be printed on a plurality of regions in the width direction of the non-print area T1 and/or the non-print area T2. When a plurality of bar codes B are formed on the medium, a plurality of bar code sensors 91 are installed at locations corresponding to the plurality of bar codes B.

In the exemplary embodiment illustrated in FIG. 1, the bar code B may be read via the sensor 81 such that a separate bar code sensor is not required. Although not illustrated, when the bar code B is printed on the non-print area T1, high and low signals corresponding to bar code information are transmitted to the controlling unit 80 when the area on which the bar code B is printed passes the sensor 81 after the top end 11 of the medium 10 is detected. The controlling unit 80 recognizes the information recorded in the bar code B via, for example, the length (i.e., continuation time) of the high and low signals. The maximum continuation time of the high or low signals caused by the bar code B is predetermined. Therefore, when the high signal of the sensor 81 surpasses the maximum continuation time, the controlling unit 80 recognizes that the bar code B has completely passed the sensor 81. Then, when the signal of the sensor 81 changes from high to low, the controlling unit 80 recognizes that the bottom end 12 of the medium 10 is detected, as illustrated in FIG. 6.

When the bar code B is printed on the non-print areas T1 and T2, after reading the bar code information of the bar code B printed on the non-print area T1 as described above, the high and low signals corresponding to bar code information are transmitted to the controlling unit 80 when the bar code B printed on the non-print area T2 passes the sensor 81. Then, the controlling unit 80 recognizes the information recorded in the bar code B. When the high signal of the sensor 81 continues after the maximum continuation time, the controlling unit 80 recognizes that the bar code B has completely passed the sensor 81. Then, when the signal of the sensor 81 changes from high to low, the controlling unit 80 recognizes that the bottom end 12 of the medium 10 is detected, as illustrated in FIG. 6.

When the bar code B is printed only in the non-print area T1, the bar code B may be read by the sensor 82 illustrated in FIG. 10.

According to the above described structure of the image forming apparatus, the sensors 81 and 82 may be used as an alignment sensor to align the print start location Q of the medium 10 with the image forming line as well as a bar code sensor to read the bar code B. The bar code B may be printed on a plurality of areas in the width direction of the medium 10 in the non-print area T1 and/or the non-print area T2. A plurality of sensors 81 or 82 are installed to match the width direction of the plurality of bar codes B.

According to the image forming apparatus of exemplary embodiments of the present invention and the method of using the same, loss of a printed image may be substantially prevented by matching a print start location of the medium with the image forming line using a sensor, and a good quality color image may be obtained when printing color images by moving a medium back and forth a plurality of times.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus, comprising:

an image forming unit that prints an image on a medium;

a transporting unit that transports the medium in a first direction and a second direction, which is substantially opposite to the first direction; and a sensor disposed a predetermined distance from the transporting unit in the second direction to detect the medium, wherein the image forming apparatus aligns a print start location of the medium with an image forming line of the image forming unit by detecting an end of the medium in the second direction with the sensor, and wherein the transporting unit is disposed between the image forming unit and the sensor, and the image forming unit prints the image on the medium while the transporting unit transports the medium in the second direction.

2. The image forming apparatus of claim 1, wherein a bar code is formed on at least one end of the medium in the first or second direction, the bar code having information regarding the medium; and the sensor is disposed to read the bar code.

3. The image forming apparatus of claim 1, wherein a bar code is formed on at least one end of the medium in the first or second direction, the bar code having information regarding the medium; and a bar code sensor is disposed in the image forming apparatus to read the bar code.

4. The image forming apparatus of claim 1, wherein the medium is a thermal medium having at least one thermal ink layer; and the image forming unit has a thermal printing head that prints the image by applying heat to the medium and a platen roller that supports the medium by being disposed opposite the thermal printing head.

5. The image forming apparatus of claim 4, wherein the thermal printing head is adapted to move between a first location opposite a first surface of the medium and a second location opposite a second surface of the medium, the second surface being opposite the first surface, and the thermal printing head is adapted to print an image at the first location and at the second location.

6. The image forming apparatus of claim 5, wherein the thermal printing head rotates about a rotation axis of the platen roller when moving between the first location and the second location.

7. The image forming apparatus of claim 1, wherein the sensor is spaced in the second direction from the transporting unit.

8. The image forming apparatus of claim 3, wherein the bar code sensor is spaced in the first direction from the transporting unit.

9. An image forming apparatus, comprising:

an image forming unit that prints an image on a medium;

a transporting unit that transports the medium in a first direction and a second direction, which is the substantially opposite to the first direction; and a sensor disposed a predetermined distance from the image forming unit in the first direction to detect the medium, wherein the image forming apparatus aligns a print start location of the medium with the image forming line of the image forming unit by detecting an end of the medium towards the first direction with the sensor, and wherein the image forming unit prints the image on the medium while the transporting unit transports the medium in the second direction.

10. The image forming apparatus of claim 9, wherein a bar code is formed on at least one end of the medium in the first or second direction, the bar code having information regarding the medium; and the sensor is disposed to read the bar code.

11. The image forming apparatus of claim 9, wherein a bar code is formed on at least one end of the medium in the first or second direction, the bar code having information regarding the medium; and the image forming apparatus has a bar code sensor to read the bar code.

12. The image forming apparatus of claim 9, wherein the medium is a thermal medium having at least one thermal ink layer, and the image forming unit has a thermal printing head that prints the image by applying heat to the medium and a platen roller that supports the medium by being disposed opposite the thermal printing head.

13. The image forming apparatus of claim 12, wherein the thermal printing head is adapted to move between a first location opposite a first surface of the medium and a second location opposite a second surface of the medium, the second surface is opposite the first surface, and the thermal printing head is adapted to print an image at the first location and at the second location.

14. The image forming apparatus of claim 13, wherein the thermal printing head rotates about a rotation axis of the platen roller to move between the first location and the second location.

15. The image forming apparatus of claim 9, wherein the sensor is spaced in the first direction from the transporting unit.

16. The image forming apparatus of claim 11, wherein the bar code sensor is spaced in the first direction from the transporting unit.

17. A method of forming an image, comprising:

providing an image forming unit that prints an image on a medium, a transporting unit that transports the medium in a first direction and a second direction substantially opposite to the first direction, and a sensor placed a predetermined distance from the transporting unit in the second direction for detecting the medium;

placing the image forming unit at a first location opposite a first surface of the medium;

detecting an end of the medium in the second direction using the sensor while transporting the medium in the first direction;

stopping transporting of the medium in the first direction when the end of the medium in the second direction is placed between the transporting unit and the sensor;

detecting again the end of the medium in the second direction while transporting the medium in the second direction;

aligning a print start location of the medium with an image forming line of the image forming unit by further transporting the medium a predetermined distance; and printing an image on the first surface of the medium while transporting the medium in the second direction.

18. The method of claim 17, further comprising:

placing the image forming unit at a second location opposite a second surface of the medium;

detecting with a sensor the end of the medium in the second direction while transporting in the first direction the medium having the image formed on the first surface;

stopping transporting of the medium when the end of the medium in the second direction is disposed between the transporting unit and the sensor;

detecting again the end of the medium in the second direction while transporting the medium in the second direction using the sensor;

aligning the print start location of the medium with the image forming line of the image forming unit by further transporting the medium a predetermined distance; and printing an image on the second surface of the medium while transporting the medium in the second direction.

19. The method of claim 18, wherein the medium is a thermal medium having at least one thermal ink layer;

the image forming unit has a thermal printing head that prints the images by applying heat to the medium and a platen roller that supports the medium by being placed opposite the thermal printing head; and the thermal printing head rotates with about a rotation axis of the platen roller to move between the first location and the second location.

20. The method of claim 17, further comprising:

reading a barcode disposed on the medium with the sensor to obtain characteristics of the medium.

* * * * *